US007563423B2

(12) United States Patent
Jian et al.

(10) Patent No.: US 7,563,423 B2
(45) Date of Patent: Jul. 21, 2009

(54) METHOD AND APPARATUS FOR CATALYST REGENERATION

(75) Inventors: Mou Jian, Knoxville, TN (US); James D. Rowland, Knoxville, TN (US); Erland L. E. Klintenheim, Ingelstad (SE)

(73) Assignee: ALSTOM Technology Ltd, Baden (CH)

( * ) Notice: Subject to any disclaimer, the term of this patent is extended or adjusted under 35 U.S.C. 154(b) by 170 days.

(21) Appl. No.: 11/644,376

(22) Filed: Dec. 22, 2006

(65) Prior Publication Data

US 2008/0152564 A1 Jun. 26, 2008

(51) Int. Cl.
*B01D 53/50* (2006.01)
*B01D 53/56* (2006.01)

(52) U.S. Cl. ..... 423/239.1; 423/242.1; 423/244.09; 502/20; 502/34; 502/53; 502/55

(58) Field of Classification Search ..... 423/239.1, 423/242.1, 244.09; 422/168, 169, 170, 171, 422/178, 181; 502/20, 34, 53, 55
See application file for complete search history.

(56) References Cited

U.S. PATENT DOCUMENTS 4,101,634 A * 7/1978 Ploeg ..... 423/239.1
4,142,989 A * 3/1979 Kohama et al. ..... 502/34
4,793,981 A * 12/1988 Doyle et al. ..... 423/239.1
6,779,339 B1 8/2004 Laroo et al.
6,946,419 B2 9/2005 Kaefer
2001/0004450 A1 * 6/2001 Held ..... 422/212
2005/0284139 A1 12/2005 Verkiel et al.

FOREIGN PATENT DOCUMENTS

| | | |
|---|---|---|
| EP | 0862941 | 9/1998 |
| WO | WO 95/21019 | 8/1995 |
| WO | WO 01/51178 | 7/2001 |

OTHER PUBLICATIONS

PCT International Search Report and The Written Opinion of the International Searching Authority—dated Apr. 6, 2008 (PCT/US2007/087872).

* cited by examiner

*Primary Examiner*—Timothy C Vanoy
(74) *Attorney, Agent, or Firm*—Wiggin and Dana LLP; Anthony P. Gangemi

(57) ABSTRACT

The present invention relates to the regeneration of a SOx removal catalyst (14) and a NOx reducing catalyst (12). Additionally, this invention relates to the reduction or elimination of sulfur breakthrough from the SOx removal catalyst (14) to the NOx reducing catalyst (12) that may occur during or after a regeneration sequence.

11 Claims, 5 Drawing Sheets

METHOD AND APPARATUS FOR CATALYST REGENERATION

BACKGROUND OF THE INVENTION

1. Field of the Invention

The present invention relates to a method and system for the regeneration of a nitrogen oxide (NOx) reducing catalyst and a sulfur oxide (SOx) removal catalyst. More particularly, the present invention relates to a method for regenerating both the NOx reducing catalyst and the SOx removal catalyst while additionally preventing sulfur poisoning of the NOx reducing catalyst.

2. Brief Description of Art

Methods for removing contaminants such as NOx from the exhaust gases of diesel engines, gas turbines, and the like without the need to use ammonia have been in development since the middle of the 1990s. One such method is known as a NOx reducing catalyst. A NOx reducing catalyst is a support structure coated with a sorbent material for reducing both carbon monoxide (CO) and NOx emissions. In an oxidation and sorption step, the NOx reducing catalyst works by simultaneously oxidizing CO to $CO_2$ and NO to $NO_2$. The $NO_2$ is sorbed by the sorbent material coated on the catalyst, which is typically potassium carbonate. The $CO_2$ is exhausted out of the stack. When the $NO_2$ is sorbed by the potassium carbonate, potassium nitrites and potassium nitrates are formed.

Since the NOx reducing catalyst can easily be deactivated by SOx and other sulfur compounds found in the exhaust gas, another system known as a SOx removal catalyst is typically arranged upstream of the NOx reducing catalyst, either as a primary SOx removal unit or, more typically, for removing residual amounts of SOx from the exhaust gas. The SOx removal catalyst sorbs SOx from the exhaust gas thereby protecting the NOx reducing catalyst from sulfur poisoning. The SOx removal catalyst is a support structure coated with a sorbent that is effective to sorb SOX from the exhaust gas.

As used herein, the terms "sorb", "sorbency", "sorbed", "sorption", and the like, indicate either absorbency or adsorbency or a combination thereof. The NOx reducing catalyst can remove NOx from an exhaust gas stream by adsorption, absorption or a combination thereof. Similarly, the SOx removal catalyst can remove SOx by adsorption, absorption, or a combination thereof.

In the traditional system utilizing a SOx removal catalyst and a NOx reducing catalyst, as soon as the depositing capacity of the sorbent material is exhausted, the sorbent material on the catalysts must be regenerated. Regeneration of the sorbent material is traditionally done in situ by isolating the substrate and sorbent material from the exhaust gas flow and contacting the sorbent material with a regeneration gas.

In one system, the regeneration gas contains a portion of molecular hydrogen as the active substance. The remainder of the gas is a carrier gas which consists of steam and may contain small amounts of molecular nitrogen and carbon dioxide. The regeneration gas reacts with the sorbed nitrites and nitrates on the sorbent material of the NOx reducing catalyst to form water vapor and nitrogen which are emitted with the regeneration gas exhaust. Any carbon dioxide present in the regeneration gas reacts with the potassium nitrites and potassium nitrates to form potassium carbonate. As discussed above, potassium carbonate is the sorbent material on the surface of the substrate before the oxidation and sorption step began. The $SO_x$ accumulated on the SOx removal catalyst is converted into $SO_2$ and water in the presence of hydrogen in the regeneration gas. In regeneration of the SOx removal catalyst, the catalyst must be reduced (i.e. freed of sorbed oxygen) before the liberation of the sorbed sulfur dioxide can begin.

If the SOx removal catalyst is not fully regenerated at the end of the regeneration, a "puff" of sulfur is often released. Upon re-introducing the exhaust gas into the SOx removal and NOx reducing catalysts, the sulfur puff is entrained into the exhaust gas and carried to the NOx reducing catalyst. As mentioned above, sulfur exposure is detrimental to the NOx reducing catalyst as it destroys the sorption capacity of the NOx reducing catalyst, which cannot be recovered in the regeneration sequence described above.

Therefore, the sulfur puff that occurs during traditional regeneration sequences used in these processes is detrimental to the NOx reducing catalyst. Additionally, a small amount of SOx may also slip-over to the NOx reducing catalyst during the sorption step. The slip-over depends on several factors, including the regeneration and sorption efficiency and capacity of the SOx removal catalyst.

The regeneration sequence traditionally takes place in an oxygen free environment. Additionally, the regeneration sequence should take place in an area isolated from the exhaust gas stream.

In another embodiment disclosed in the art for installations operating at temperatures greater than 450° F., the sorbent material can be regenerated by introducing a small quantity of natural gas with a carrier gas such as steam, to a steam reforming catalyst, and then to the NOx reducing catalyst. In this embodiment, the reforming catalyst initiates the conversion of methane in the natural gas to hydrogen. The conversion is completed over the NOx reducing catalyst.

It should be noted that the SOx removal catalyst utilizes the same oxidation/sorption step and regeneration sequence as the NOx reducing catalyst.

To allow for in situ regeneration without the total disruption of the gas stream flow, the NOx reducing catalyst and SOx removal catalyst are placed in reactor compartments with large dampers at each inlet and outlet. During regeneration, the dampers close, preventing the exhaust gas stream from entering into the reactor compartments. The regeneration gas is then ducted through a distribution system into the compartments to regenerate the sorbent material.

A typical NOx reducing catalyst for a gas turbine of a combined cycle power plant or the like has five to fifteen individually isolatable reactor compartments, 80% of which are in the oxidation/sorption sequence and 20% of which are in the regeneration sequence at any one time. A regeneration sequence typically takes no less than 3 minutes and the oxidation/sorption sequence typically takes no less than 10 minutes, and depends on a variety of factors, including, but not limited to the sorption capacity of the catalysts and the efficiency of regeneration. Accordingly, the efficiency of NOx removal is dependent on the efficiency of regeneration.

BRIEF SUMMARY OF THE INVENTION

One aspect of the invention relates to a method for removing nitrogen oxides from an exhaust gas stream, wherein the exhaust gas stream is contacted with a SOx removal catalyst which reduces the content of sulfur oxides in the exhaust gas stream and wherein the exhaust gas is thereafter contacted with a NOx reducing catalyst which converts nitrogen oxides to $NO_2$ which is sorbed by the NOx reducing catalyst, the SOx removal catalyst and NOx reducing catalyst housed within a reactor compartment, the improvement comprising the steps of: (a) isolating the reactor compartment from the flow of the exhaust gas stream; (b) directing a regeneration gas into the isolated reactor compartment for a time effective to regenerate sorbency of the NOx reducing catalyst; (c) after regenerating the sorbency of the NOx reducing catalyst, then directing the regeneration gas into the isolated reactor compartment for a time effective to regenerate sorbency of the SOx removal catalyst; and (d) thereafter recommencing the flow of the exhaust gas stream through the reactor compartment.

Another aspect of the present invention relates to a method for removing contaminants from an exhaust gas stream by utilizing a NOx reducing catalyst and a SOx removal catalyst, the method comprising: introducing the exhaust gas stream into at least one reactor compartment, the at least one reactor compartment comprising a SOx removal catalyst and a NOx reducing catalyst; removing the contaminants from the exhaust gas stream by sorbing the contaminants on the SOx removal catalyst and the NOx reducing catalyst; isolating at least one reactor compartment from the exhaust gas stream; regenerating the NOx reducing catalyst prior to regenerating the SOx removal catalyst by introducing a regeneration gas to the isolated reactor compartment, wherein the regeneration gas contacts the NOx reducing catalyst and contacts the SOx removal catalyst, thereby removing the contaminants therefrom; after regenerating the SOx removal catalyst, then introducing a sulfur removal gas to the isolated reactor compartment, wherein the sulfur removal gas is effective to remove an amount of sulfur from the SOx removal catalyst; and after introducing the sulfur removal gas, then introducing the exhaust gas stream to the reactor compartment whereby the SOx removal catalyst and the NOx reducing catalyst can sorb additional contaminants from the exhaust gas.

Another aspect of the present invention relates to an apparatus for regenerating a SOx removal catalyst and a NOx reducing catalyst, the apparatus comprising: a pair of dampers, wherein one damper is parallel to the other damper; a SOx removal catalyst disposed parallel to a NOx reducing catalyst, wherein the SOx removal catalyst and the NOx reducing catalyst are disposed between the pair of dampers; a valve disposed between one damper and the SOx removal catalyst; a valve disposed between one damper and the NOx reducing catalyst; and a controller, wherein the controller operates the dampers to isolate the SOx removal catalyst and the NOx reducing catalyst from an exhaust gas, further wherein the controller operates the valves to direct at least one of a regeneration gas, a sulfur removal gas, or a mixture thereof through the SOx removal catalyst and the NOx reducing catalyst.

This aspect of the invention, as well as others, is described in more detail in the following detailed description.

BRIEF DESCRIPTION OF THE DRAWINGS

For the purpose of illustrating the invention, the drawings show a form of the invention that is presently preferred. However it should be understood that the present invention is not limited to the precise arrangements and instrumentalities shown in the drawings, wherein.

DETAILED DESCRIPTION OF THE INVENTION

One or more layers of the SOx removal catalyst and the NOx reducing catalyst may be used in a reactor compartment. For example, in one embodiment of the invention, there are two layers of the SOx removal catalyst and three layers of the NOx reducing catalyst. It is recognized that the number of layers used in the NOx reducing and SOx removal catalysts can vary in different applications, therefore, there is no limitation on the number of catalysts and the number of layers that can be used in the system and process described herein. Furthermore, any reference made to "a" NOx reducing catalyst or "a" SOx removal catalyst is not meant to limit the number of catalysts or number of layers present in the catalyst.

Figure 1:
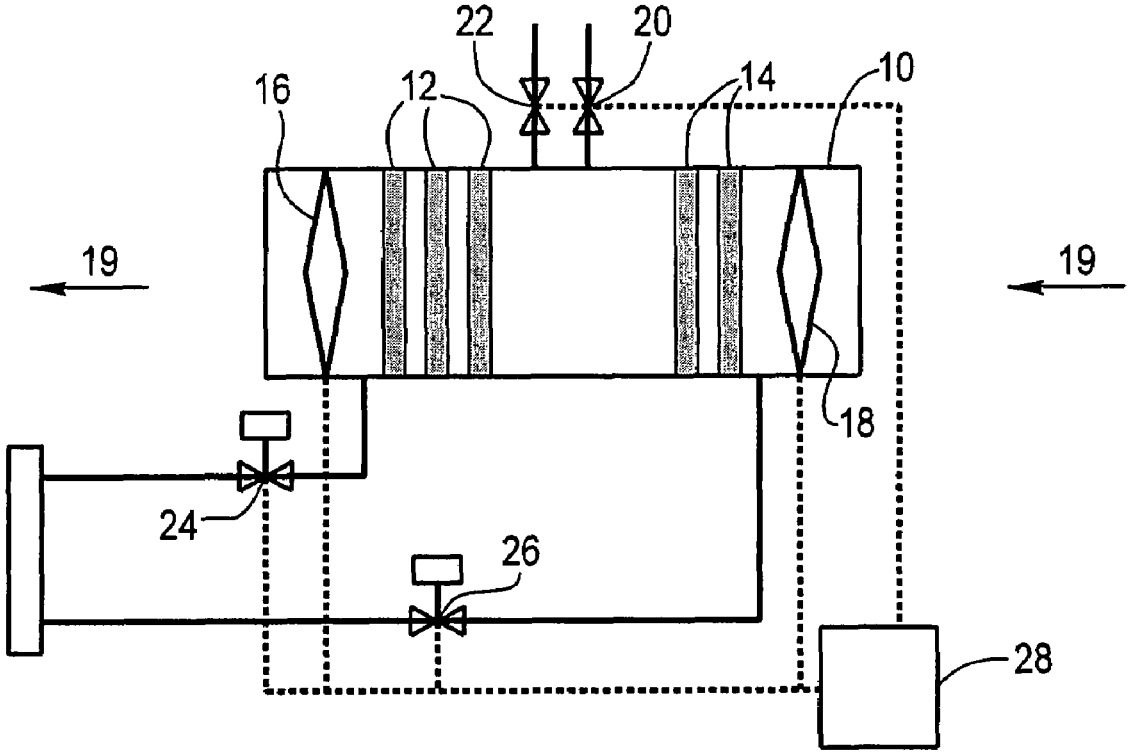
FIG. 1 is a reactor compartment containing a NOx reducing catalyst and a SOx removal catalyst.
Figure 2:
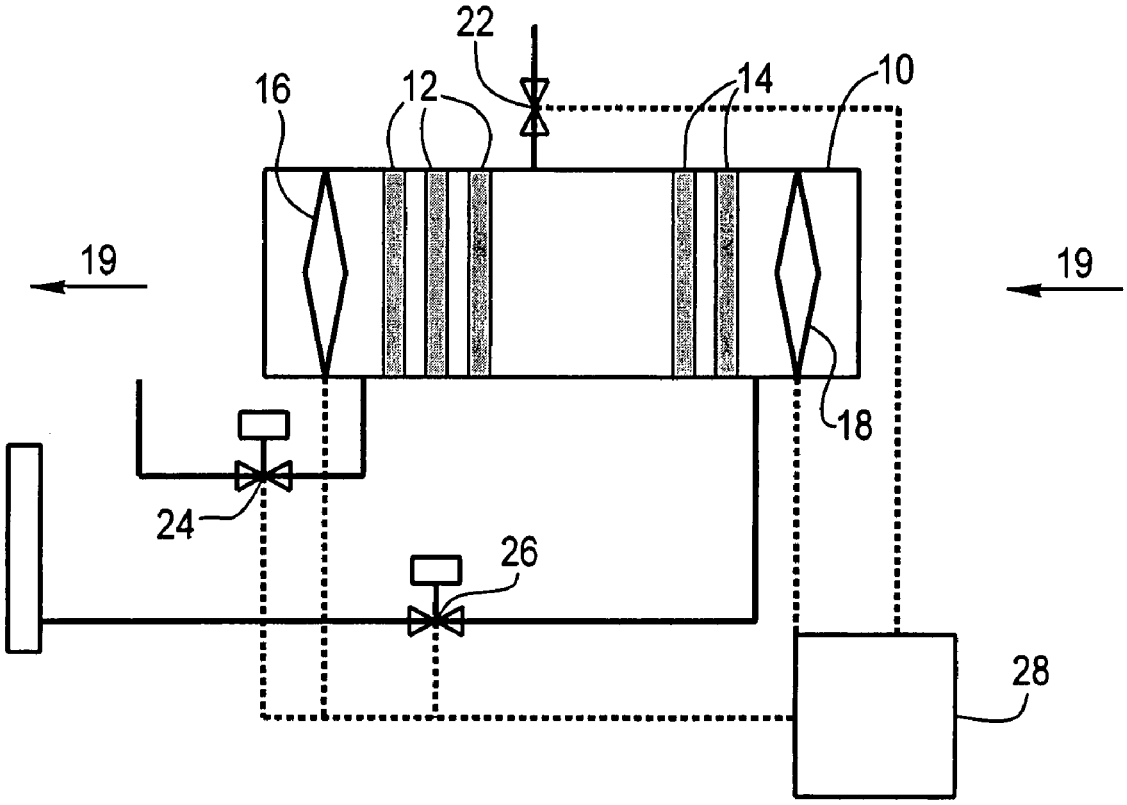
FIG. 2 is a reactor compartment containing a NOx reducing catalyst and a SOx removal catalyst.

As shown in FIGS. 1 and 2, a reactor compartment 10 houses a NOx reducing catalyst 12 downstream of a SOx removal catalyst 14. Examples of NOx reducing and SOx removal catalysts are known in the art, and include, for example: SCONOx®, SCOSOx® and EMx®, which are all commercially available from EmeraChem, LLC of Knoxville, Tenn.

Reactor compartment 10 also includes a pair of dampers 16 and 18, which provide a physical barrier that prevents an exhaust gas stream 19 from entering into the reactor compartment during the regeneration sequence.

In one embodiment of reactor compartment 10, as shown in FIG. 1, during the regeneration sequence, a regeneration gas enters into the reactor compartment through a regeneration gas inlet 20. Inlet 20 is generally a pipe or other conduit by which the regeneration gas can travel through and enter into reactor compartment 10. Inlet 20 may include valves or other controls that regulate the amount of regeneration gas which enters reactor compartment 10. Inlet 20 is typically positioned between SOx removal catalyst 14 and NOx reducing catalyst 12. However, it is contemplated that inlet 20 may be placed at another position in reactor compartment 10.

The regeneration gas may include hydrogen, natural gas, steam, other inert gases or a mixture thereof. In one embodiment, the regeneration gas is a mixture of hydrogen carried in steam which contains a small amount of nitrogen and carbon monoxide. The regeneration gas typically consists of 2-3% hydrogen in a carrier gas such as steam, however other inert gases may be used as the carrier gas. Other regeneration gases known in the art to regenerate SOx removal catalyst 14 and NOx reducing catalyst 12 may be used.

Still referring to FIG. 1, a sulfur removal gas enters reactor compartment 10 through a sulfur removal gas inlet 22. The sulfur removal gas is an oxygen-containing gas. Air is one example of a sulfur-removing gas, however other oxygen containing gases, including solely oxygen, may be used. The sulfur removal gas is added towards the end of the regeneration sequence to maximize the removal of SOx and other sulfur-containing compounds.

Reactor compartment 10 may have several valves, which facilitate the movement and the removal of the regeneration gas and sulfur removal gas from the reactor compartment. Reactor compartment 10 has a valve 24, which is disposed between damper 16 and NOx reducing catalyst 12. Reactor compartment 10 further includes a valve 26 which is disposed between SOx removal catalyst 14 and damper 18. It is contemplated that valves 24 and 26 can be positioned at another location in reactor compartment 10. Valves 24 and 26 are typically connected to pipes or other conduits that allow the regeneration gas and the sulfur removal gas to exit from reactor compartment 10.

The opening and closing of inlets 20 and 22, valves 24 and 26, as well as dampers 16 and 18 are controlled by a controller 28. Controller 28 can be any suitable control mechanism. Examples of such include distributed control systems (DCS) and programmable logic control (PLC).

In another embodiment of reactor compartment 10, as shown in FIG. 2, the regeneration gas is introduced to the reactor compartment through valve 24 and exits the reactor compartment through valve 26. The sulfur removal gas may be introduced by inlet 22 or valve 24. This embodiment of reactor compartment 10 does not utilize an inlet 20 to introduce the regeneration gas.

In the present invention, regeneration of NOx reducing catalyst 12 is always followed by the regeneration of SOx removal catalyst 14. In one embodiment, NOx reducing catalyst 12 is regenerated first, followed by regeneration of SOx removal catalyst 14. In another embodiment, SOx removal catalyst 14 is regenerated first, followed by regeneration of NOx reducing catalyst 12, then another regeneration of the SOx removal catalyst 14. In either embodiment, a sulfur removal gas, which is effective to remove excess sulfur and/or $SO_x$ compounds from the SOx removal catalyst 14, is introduced into the reactor compartment. Removal of sulfur containing compounds reduces or eliminates sulfur poisoning of NOx reducing catalyst 12.

The order of regeneration and introduction of the sulfur removal gas is controlled by the inlets and valves connected to reactor compartment 10 which houses SOx removal catalyst 14 and NOx reducing catalyst 12.

Figure 3:
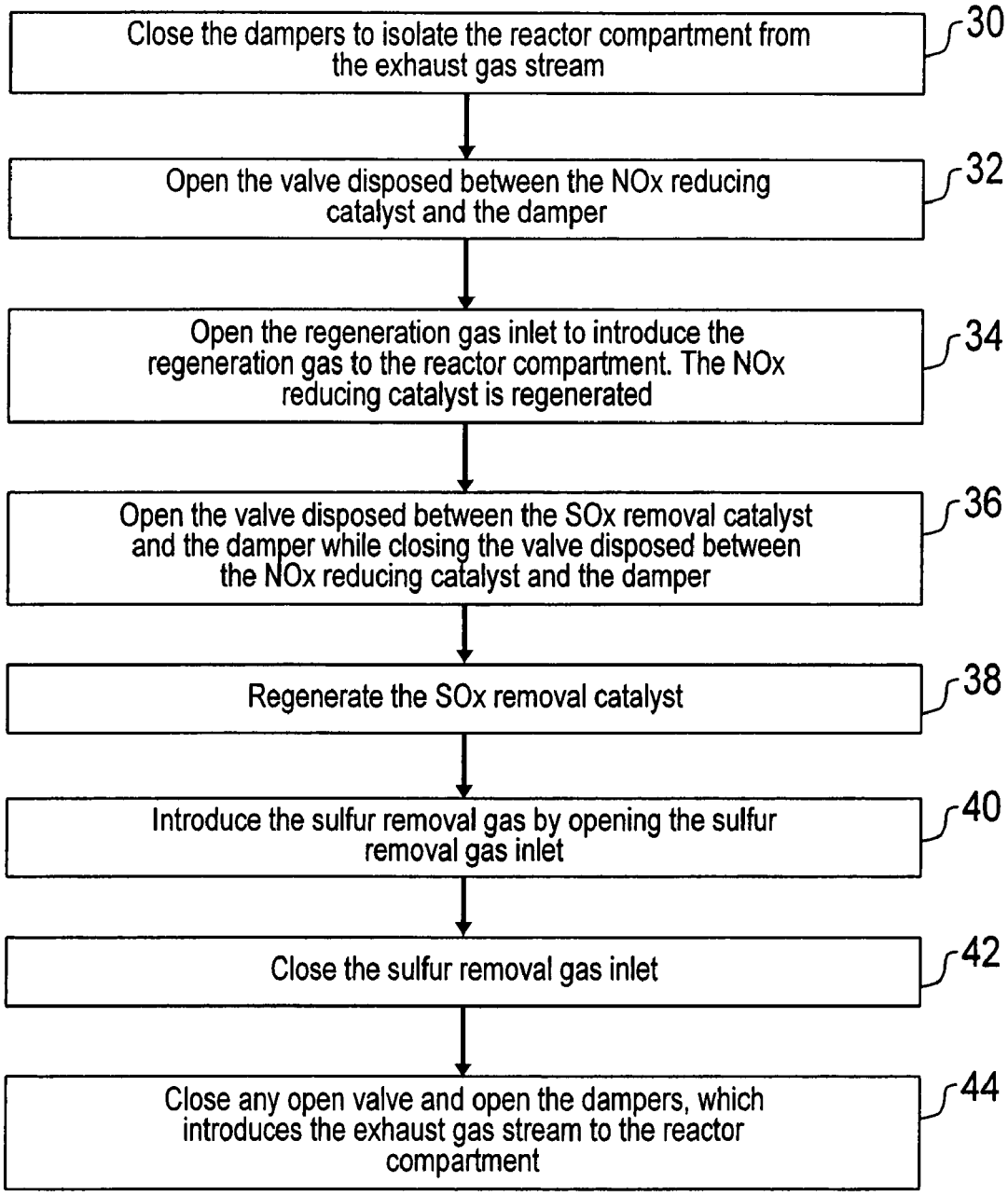
FIG. 3 is a flow chart of a regeneration sequence.

As shown in FIG. 3, in one embodiment of the present invention SOx removal catalyst 14 is regenerated only once. In step 30, dampers 16 and 18 are closed to isolate reactor compartment 10 from exhaust gas stream 19.

In step 32, valve 24 is opened. In step 34, inlet 20 is opened to introduce the regeneration gas to reactor compartment 10. Open valve 24 facilitates the regeneration of NOx reducing catalyst 12 by drawing the regeneration gas through the NOx reducing catalyst. The regeneration gas is exhausted by valve 24.

In step 36, valves 24 and 26 are modulated to direct the regeneration gas to SOx removal catalyst 14. Specifically, valve 26 opens while valve 24 is closed. When valve 26 is opened, the regeneration gas is drawn toward valve 26 and through SOx removal catalyst 14. In step 38, SOx removal catalyst 14 is regenerated by the regeneration gas. The regeneration gas is exhausted by valve 26.

In step 40, the sulfur removal gas is introduced to reactor compartment 10. This can be accomplished in at least two ways: (1) close inlet valve 20 to stop the flow of the regeneration gas to into the reactor compartment and open inlet 22 to introduce a sulfur removal gas; or (2) leave inlet 20 open and open inlet 22 to introduce the sulfur removal gas. In either instance, since valve 26 remains open, the sulfur removal gas is drawn through SOx removal catalyst 14, thereby removing SOx therefrom.

In step 42, inlet 22 is closed, which stops the flow of the sulfur removal gas to reactor compartment 10. In step 44, all remaining open valves are closed, including valve 26 and valve 20, and dampers 16 and 18 are opened, thereby introducing exhaust gas stream 19 to reactor compartment 10.

Figure 4:
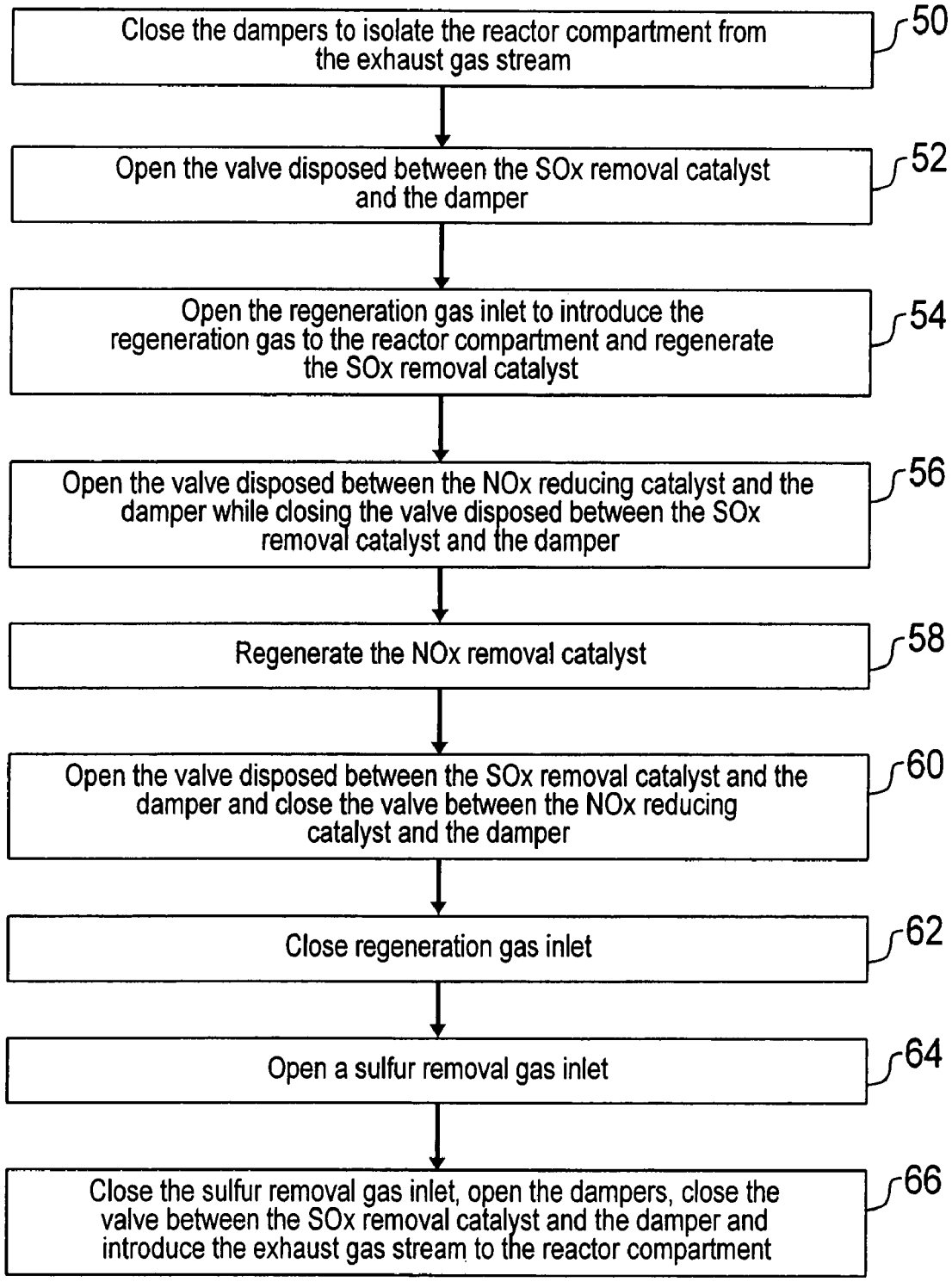
FIG. 4 is a flow chart of a regeneration sequence.

In another embodiment, as shown in FIG. 4, SOx removal catalyst 14 is regenerated first, followed by regeneration of NOx reducing catalyst 12 and a second regeneration of the SOx removal catalyst.

Still referring to FIG. 4, in step 50, dampers 16 and 18 close to isolate reactor compartment 10 from exhaust gas stream 19. In step 52, valve 26 is opened. In step 54, inlet 20 is opened to introduce the regeneration gas to reactor compartment 10. Open valve 26 facilitates the regeneration of SOx removal catalyst 14. By opening valve 26 the regeneration gas is drawn towards valve 26 and through SOx removal catalyst 14. The regeneration gas regenerates SOx removal catalyst 14 and is exhausted by valve 26.

In step 56, valves 24 and 26 are modulated to direct the regeneration gas to NOx reducing catalyst 12. Specifically, valve 24 opens while valve 26 is closed. When valve 24 is opened, the regeneration gas is drawn toward valve 24 and through NOx reducing catalyst 12. In step 58, NOx reducing catalyst 12 is regenerated by the regeneration gas, and the regeneration gas is exhausted by valve 24.

In step 60, valve 26 is opened while valve 24 is closed. Opening valve 26 again draws the regeneration gas through SOx removal catalyst 14, thereby regenerating the SOx removal catalyst for a second time. In step 62, inlet 20 is closed to stop the flow of the regeneration gas to reactor compartment 10.

In step 64, inlet 22 is opened to introduce a sulfur removal gas to SOx removal catalyst 14. Since valve 26 remains open, the sulfur removal gas is drawn towards open valve 26 and through SOx removal catalyst 14. The sulfur removal gas removes excess sulfur containing compounds and prevents them from slipping over to NOx reducing catalyst 12.

After SOx removal catalyst 14 has been exposed to the sulfur removal gas for an amount of time sufficient to remove the sulfur containing compounds, in step 66, inlet 22 closes, dampers 16 and 18 are opened, valve 26 closes, and exhaust gas stream 19 is introduced to compartment 10. The sulfur removal gas and any remaining regeneration gas are removed when dampers 16 and 18 open.

In another embodiment of the invention, the regeneration gas is introduced via valve 24. Such a reactor compartment is illustrated in FIG. 2 and the regeneration sequence is illustrated in FIG. 5.

Figure 5:
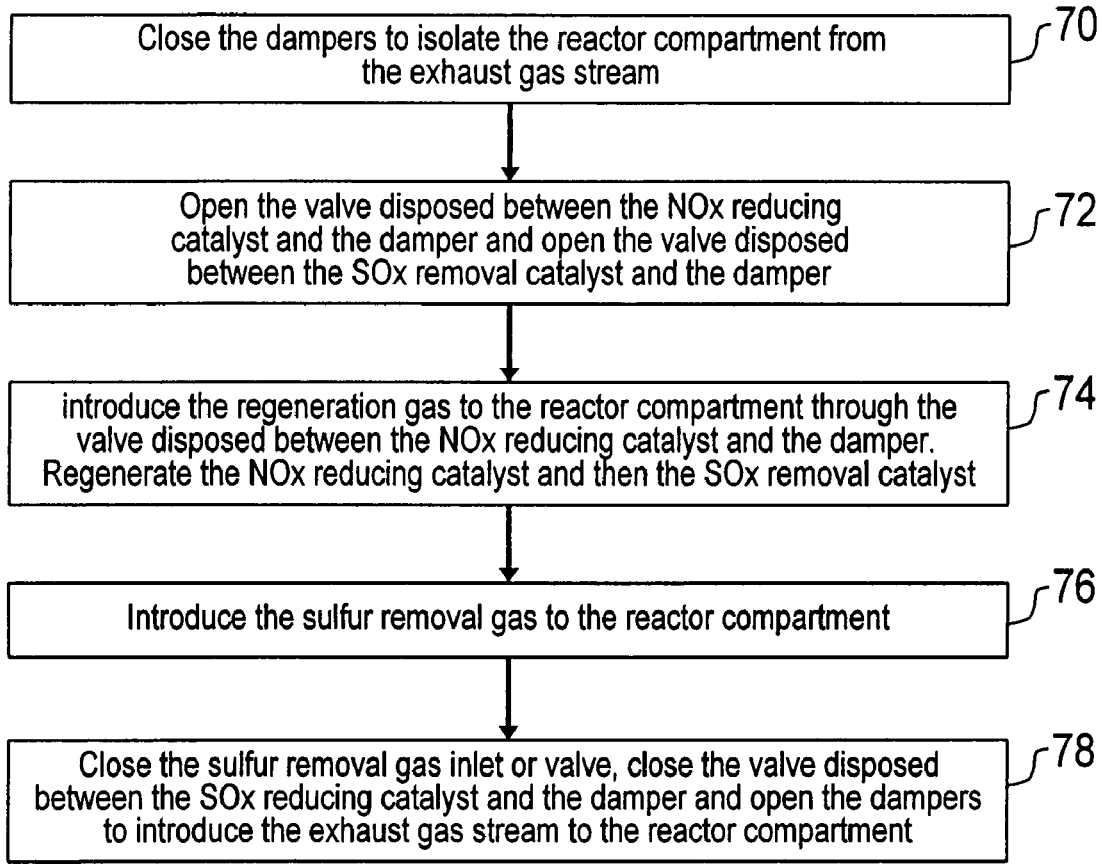
FIG. 5 is a flow chart of a regeneration sequence.

Referring now to FIG. 5, as shown in step 70, dampers 16 and 18 are closed, thereby isolating reactor compartment 10 from exhaust gas stream 19. In step 72, valves 24 and 26 are both opened. In step 74, a regeneration gas is introduced to reactor compartment 10 by valve 24. Because valve 26 is open, the regeneration gas flows through and regenerates NOx reducing catalyst 12 and then regenerates SOx removal catalyst 14. The regeneration gas is exhausted from valve 26.

In step 76, a sulfur removal gas is introduced to reactor compartment 10. In one embodiment, valve 24 is closed and the sulfur removal gas is introduced via inlet 22. Alternatively, the sulfur removal gas can be introduced via valve 24. When the sulfur removal gas is introduced via valve 24, valve 24 is not closed and instead remains open.

Since valve 26 remains open, the sulfur removal gas is drawn through SOx removal catalyst 14 and exhausted from valve 26.

In step 78, the valve or inlet introducing the sulfur removal gas closes, valve 26 closes and dampers 16 and 18 open, thereby introducing exhaust gas 19 to reactor compartment 10.

SOx removal catalyst 14 and NOx reducing catalyst 12 are exposed to the regeneration gas for a time sufficient to regenerate the catalysts. The time period is determined by the absorption capacity and the volume of the catalysts, however, typically the catalysts are exposed to the regeneration gas for a time period of three or more minutes.

The sulfur removal gas is added to reactor compartment 10 for a time between about 5 to about 30 seconds, but could be added for up to several minutes, depending on the parameters of the particular system.

Typically, the regeneration sequence takes about 3 to 10 minutes. The addition of the sulfur removal gas represents roughly 1% to 15% of the total regeneration time. However, the introduction of the sulfur removal gas reduces the amount of breakthrough sulfur to less than ⅓ of the amount which breaks through during the current regeneration sequence not utilizing sulfur removal gas.

In addition to reduction of breakthrough $SO_2$, the sulfur removal gas results in higher working capacity of the SOx removal catalyst as more $SO_2$ has been removed from it. This in turn results in less $SO_2$ escaping the SOx removal catalyst to poison the NOx reducing catalyst during the sorption process. Further, the presently described regeneration sequence substantially or totally eliminates the "puff" of sulfur, which is often released during traditional regeneration sequences. Accordingly, upon re-introducing the exhaust gas into the SOx removal and NOx reducing catalysts, a sulfur puff is no longer entrained into the exhaust gas and brought to the NOx reducing catalyst.

What is claim is

1. In a method for removing nitrogen oxides from an exhaust gas stream, wherein the exhaust gas stream is contacted with a SOx removal catalyst which reduces the content of sulfur oxides in the exhaust gas stream and wherein the exhaust gas is thereafter contacted with a NOx reducing catalyst which converts nitrogen oxides to $NO_2$ which is sorbed by the NOx reducing catalyst, the SOx removal catalyst and NOx reducing catalyst housed within a reactor compartment, the improvement comprising the steps of:

(a) isolating the reactor compartment from the flow of the exhaust gas stream;

(b) directing a regeneration gas into the isolated reactor compartment for a time effective to regenerate sorbency of the NOx reducing catalyst;

(c) after regenerating the sorbency of the NOx reducing catalyst, then directing the regeneration gas into the isolated reactor compartment for a time effective to regenerate sorbency of the SOx removal catalyst;

(d) introducing a sulfur removal gas into the reactor compartment after step (c), but prior to step (e), wherein the sulfur removal gas is introduced for a time effective to reduce an amount of sulfur in the SOx removal catalyst; and (e) thereafter recommencing the flow of the exhaust gas stream through the reactor compartment.

2. A method according to claim 1, further comprising the step of:

directing the regeneration gas into the reactor compartment to regenerate sorbency of the SOx removal catalyst after step (a), but prior to step (b).

3. A method according to claim 1 wherein the sulfur removal gas comprises oxygen.

4. A method according to claim 1 wherein the sulfur removal gas is introduced to the reactor compartment for a time between about 5 seconds to about 30 seconds.

5. A method according to claim 1 wherein the regeneration gas comprises at least one of: hydrogen, natural gas, steam, or a mixture thereof.

6. A method according to claim 1, wherein the regeneration gas is directed into the reactor compartment by an inlet located between the SOx removal catalyst and the NOx reducing catalyst.

7. A method according to claim 1, wherein the regeneration gas is directed into the reactor compartment by a valve located between the NOx reducing catalyst and a downstream damper.

8. A method for removing contaminants from an exhaust gas stream by utilizing a NOx reducing catalyst and a SOx removal catalyst, the method comprising:

introducing the exhaust gas stream into at least one reactor compartment, the at least one reactor compartment comprising a SOx removal catalyst and a NOx reducing catalyst;

removing the contaminants from the exhaust gas stream by sorbing the contaminants on the SOx removal catalyst and the NOx reducing catalyst;

isolating at least one reactor compartment from the exhaust gas stream;

regenerating the NOx reducing catalyst prior to regenerating the SOx removal catalyst by introducing a regeneration gas to the isolated reactor compartment, wherein the regeneration gas contacts the NOx reducing catalyst and contacts the SOx removal catalyst, thereby removing the contaminants therefrom;

after regenerating the SOx removal catalyst, then introducing a sulfur removal gas to the isolated reactor compartment, wherein the sulfur removal gas is effective to remove an amount of sulfur from the SOx removal catalyst; and after introducing the sulfur removal gas, then introducing the exhaust gas stream to the reactor compartment whereby the SOx removal catalyst and the NOx reducing catalyst can sorb additional contaminants from the exhaust gas.

9. A method according to claim 8, further comprising the step of:

after isolating the reactor compartment from the exhaust gas stream, then regenerating the SOx removal catalyst prior to regenerating the NOx reducing catalyst.

10. A method according to claim 8 wherein the regeneration gas comprises hydrogen, natural gas, steam, or a mixture thereof.

11. A method according to claim 8 wherein the sulfur removal gas comprises oxygen.

* * * * *